US006719234B2

(12) United States Patent
Uhde et al.

(10) Patent No.: US 6,719,234 B2
(45) Date of Patent: Apr. 13, 2004

(54) APPARATUS ON A DIRECT ROVING WINDER FOR CONTACTLESS DETECTION OF THE ACTUAL DIAMETER OF THE ROVING PACKAGE AND A DIRECT ROVING WINDER WITH SUCH AN APPARATUS AND ALSO A METHOD FOR CONTROLLING A ROVING WINDER AND A METHOD FOR CONTROLLING A SPINNING APPLIANCE

(75) Inventors: Rainer Uhde, Luppa (DE); Ulrich Singer, Doerfles Esbach (DE)

(73) Assignee: Dietze & Schell Maschinenfabrik, Coburg (DE)

( * ) Notice: Subject to any disclaimer, the term of this patent is extended or adjusted under 35 U.S.C. 154(b) by 0 days.

(21) Appl. No.: 10/055,616

(22) Filed: Jan. 23, 2002

(65) Prior Publication Data

US 2002/0109031 A1 Aug. 15, 2002

(30) Foreign Application Priority Data

Jan. 23, 2001 (DE) ..... 201 01 126 U

(51) Int. Cl.[7] ..... B65H 54/22
(52) U.S. Cl. ..... 242/474.5; 242/485.7
(58) Field of Search ..... 262/474.4, 474.5, 262/485.4, 485.7, 920; 65/479, 491; 33/DIG. 21; 356/635

(56) References Cited

U.S. PATENT DOCUMENTS

| | | | | |
|---|---|---|---|---|
| 3,671,824 A | | 6/1972 | Dinger | |
| 3,845,912 A | | 11/1974 | Eichmanns et al. | |
| 3,897,021 A | | 7/1975 | Shape | |
| 4,146,376 A | | 3/1979 | Beckman et al. | |
| 4,229,198 A | * | 10/1980 | Coggin et al. | 242/920 |
| 4,244,533 A | | 1/1981 | Reese | |
| 4,294,416 A | | 10/1981 | Beckman | |
| 4,319,901 A | * | 3/1982 | Pellegrin et al. | 242/920 |
| 4,371,122 A | | 2/1983 | Schuller | |
| 4,436,258 A | | 3/1984 | Jackson et al. | |
| 4,988,048 A | * | 1/1991 | Lochbronner | 242/485.7 |
| 5,291,273 A | * | 3/1994 | Gelbart | 356/635 |
| 5,443,610 A | * | 8/1995 | Urruti | 65/491 |
| 5,469,149 A | | 11/1995 | Binner et al. | |
| 5,558,286 A | * | 9/1996 | Sugioka et al. | 242/474.5 |
| 5,836,532 A | | 11/1998 | Thompson | |
| 5,841,524 A | * | 11/1998 | Floch et al. | 65/491 |
| 6,110,403 A | | 8/2000 | Binner et al. | |

FOREIGN PATENT DOCUMENTS

| | | | |
|---|---|---|---|
| DE | 2161870 | | 4/1974 |
| DE | 3734095 | | 1/1989 |
| DE | 3734095 | C1 * | 1/1989 |
| DE | 3810414 | A1 * | 4/1989 |
| DE | 4414517 | | 12/1994 |
| DE | 19960285 | | 6/2000 |
| JP | 07133507 | A | 5/1995 |
| JP | 07257819 | A | 10/1995 |
| JP | 00185879 | A | 7/2000 |

* cited by examiner

*Primary Examiner*—William A. Rivera
(74) *Attorney, Agent, or Firm*—Hoffmann & Baron, LLP

(57) ABSTRACT

The direct roving winder has a machine frame which carries at least one winding spindle for the production of one or more roving packages and a cross-winding device. An apparatus for contactless detection of the actual diameter of a roving package is also provided which has a laser sensor with a transmitter and a receiver for laser radiation in which the distance of the laser sensor from the package surface is ascertained by means of the radiation from the transmitter to the package surface and back to the receiver. The laser sensor can be mounted in stationary manner on the machine frame or on the displacement device. The laser sensor can be arranged in a housing with an opening for the passage of the laser beam, in which there is a free space between the laser sensor and the inside of the housing into which compressed gas is introduced which exits through the opening.

6 Claims, 3 Drawing Sheets

APPARATUS ON A DIRECT ROVING WINDER FOR CONTACTLESS DETECTION OF THE ACTUAL DIAMETER OF THE ROVING PACKAGE AND A DIRECT ROVING WINDER WITH SUCH AN APPARATUS AND ALSO A METHOD FOR CONTROLLING A ROVING WINDER AND A METHOD FOR CONTROLLING A SPINNING APPLIANCE

FIELD OF THE INVENTION

The invention relates to an apparatus on a direct roving winder for contactless detection of the actual diameter of the roving package, in which the direct roving winder also has a machine frame with at least one winding spindle for the production of one or more roving packages and a cross-winding device.

The invention also relates to a method for controlling a roving winder, in which the package diameter is ascertained and the r.p.m. of the winding spindle is controlled depending on the package diameter ascertained. The invention also relates to a method for controlling an appliance for the spinning of glass fibres, in which a number of glass fibres are spun by means of a spinning nozzle and are wound onto a roving package by means of a direct roving winder.

BRIEF DESCRIPTION OF THE PRIOR ART

In the production of roving packages the diameter of the package, which increases during the winding, is continuously detected and the r.p.m. of the winding spindle and the movement of the cross-winding device are controlled depending on the package diameter detected.

Mechanical scanning of the package surface and thus ascertaining the package diameter in direct roving winders is known. Such an apparatus for detecting the actual diameter of the package for synthetic threads is known from U.S. Pat. No. 6,076,760.

Controlling the r.p.m. of the winding spindle and the movement of the cross-winding device depending on different process-engineering-relevant data in direct roving winders in which essentially the package diameter is calculated from the winding time and the speed of the winding spindle is also known. This measure is known from U.S. Pat. No. 4,146,376. The speed of the winding spindle is controlled corresponding to an error signal which represents the deviation from a set value. During the start-up phase of the spinning appliance the signal is modified for compensation of temperature variations of the spinning nozzle.

A measuring device for the continuous measurement of the diameter of wound packages in warping machines which has a sensor which is designed as a wave transmitter/receiver, in which the diameter is measured from the time difference between the transmission of a wave impulse and the reception of the echo impulse is known from DE-A-38 10 414. A device which operates similarly for the measurement of a warp beam diameter in which the distance is measured by triangulation is known from DE-C-37 34 095.

A method for contactless detection of a package diameter in which the distance between the sensor and the package surface and the distance between the sensor and the spindle surface is detected and the package diameter is ascertained from the difference between the winding tube distance and the package distance is known from DE-A-199 60 285.

Ascertaining the residue of yarns located on a package by means of a sensor which measures the distance between the package surface and the sensor is known from JP Patent Abstracts of Japan 07 257 819. Ascertaining the package diameter by means of such a distance sensor and controlling the tension exercised on the threads depending on the package diameter ascertained is known from JP Patent Abstracts of Japan 00 185 879.

SUMMARY OF THE INVENTION

The object of the invention is to improve the titre uniformity within a roving package.

According to the invention this object is achieved in that the apparatus for contactless detection of the actual diameter contains a laser sensor which has a transmitter and a receiver for laser radiation, in which the distance of the laser sensor from the package surface is ascertained by means of the radiation from the sensor to the package surface and back to the receiver.

Through the contactless but direct detection of the package diameter, the r.p.m. of the winding spindle and the movement of the cross-winding device (distance of the cross-winding device from the package surface) can be controlled such that rovings of higher uniformity can be spun. While according to the state of the art the package diameter is calculated by means of different process-engineering data, in particular the r.p.m. of the winding spindle, the directly measured actual diameter of the roving package is used according to the invention for control of the r.p.m. of the winding spindle with the aim of producing rovings of very uniform titre. Accordingly, the invention also relates to a method for controlling a roving winder which has a machine frame, at least one winding spindle projecting from the machine frame, a cross-winding device pivotally joined to the machine frame and a device for ascertaining the momentary diameter of a package produced on the winding spindle, in which for the production of a package, rovings are guided via the cross-winding device onto the package and the distance of the cross-winding device from the package surface is controlled by means of the ascertained momentary diameter of the package. This method is characterized in that the momentary diameter of the package is ascertained by means of a laser sensor of the type mentioned above.

It is particularly advantageous to use the signals of the sensor for controlling the spinning nozzle temperature in order to combat variations of titre which occur. For this purpose the chronology of the actual diameter, i.e. the increase in diameter, is in particular taken into account. Consequently the invention also relates to a method for controlling a device for the spinning of rovings, in which the glass filaments spun by a spinning device are wound by means of a direct roving winder. This method is characterized in that the chronology of the actual diameter of the roving package, i.e. the increase of the diameter of the roving package, is ascertained by means of a laser sensor of the abovementioned type and the temperature of the spinning nozzle is controlled depending on the ascertained chronology of the actual diameter of the roving package.

Too fast an increase of the actual diameter of the package is a consequence of too high a nozzle throughput (bushing output) and thus of too high a titre. Through reduction of the spinning nozzle temperature the nozzle throughput and thus the titre can be reduced. The connection between increase of diameter and spinning nozzle temperature depends on a multitude of parameters and must be empirically ascertained for each system.

Usually two, three or four roving packages are produced on one winding spindle. Through a corresponding number of sensors the package diameter and the increase of package diameter can be separately monitored for each roving package. The signals of the sensors are used for recognition of diameter differences between the roving packages to be jointly wound on one winding spindle. If the diameter differences are too great, various measures can be taken:

The direct roving winder can be switched off in order to check spinning geometry, thread distribution and the like;

An automatic package change can be triggered in order to avoid the production of waste;

By means of prepared signals of the sensors the temperature balance of the spinning positions can be corrected.

Accordingly, the invention also relates to a method for monitoring the mode of operation of a direct roving winder, in which a plurality of roving packages are produced on one winding spindle and in which the package diameter is ascertained. The method is characterized in that the diameter of each roving package produced on the winding spindle is detected separately by means of a laser sensor of its own of the abovementioned type, and that the diameter values ascertained by the laser sensors for each winding spindle are compared with each other and a control signal is produced if the difference in diameter exceeds a threshold value.

The signals of the sensors also make possible a thread breakage check in that the growth of the roving packages is compared with a value for the minimum growth of the packages.

The sensors can be attached in stationary manner to the machine frame or be mounted on the cross-winding device so that they move with the latter.

The laser sensor can ascertain the distance to the package surface in known manner from the propagation time of the beam from the sensor to the package surface and back to the receiver. Taking into account the dimensions and constructional data of the direct roving winder and the known position of the laser sensor on the direct roving winder, the actual diameter of the roving package can be ascertained therefrom.

The distance of the laser sensor from the package surface is preferably ascertained by the known triangulation principle. The laser beam strikes the package surface as a small point and the receiver detects the position of this point in that it determines the angle at which the beam which returns from the point strikes the receiver. As the distance between transmitter and receiver and the angle at which the beam is sent out from the receiver are fixed values, the distance of the laser sensor from the package surface can be calculated from this. The receiver inside the sensor is a photodiode line or a PSD. The photodiode line is read by a built-in microcontroller. From the distribution of the beam returning from the point on the package surface on the photodiode line, the microcontroller calculates the angle exactly and from this the distance to the package surface. An OADM™ laser distance sensor from WayCon Positionsmesstechnik GmbH, Inselkammerstr. 8, 82008 Unterhaching, Germany is suitable.

In direct winding of glass fibres or rovings under the spinning position, there is a danger of soiling the laser sensors, as dirt can be produced here by water and size (sticky substance) and also glass fibre fly. These substances and particles are whirled around by the air vortex produced by the rotating package and can within a very short time so severely soil the laser sensors that they break down. The laser sensor is therefore preferably arranged in a housing which has an opening for the passage of the laser beam, gas being blown in in the space between the laser sensor and the housing, which can exit from the opening. The penetration of these substances and particles and their deposition on the optics of the laser sensor is thereby prevented.

It is expedient for the opening to be provided with an attachment which has a drip course pointing away from the opening. This attachment ensures that projections of dirt forming over time do not come into the path of the beam, so that the laser beam can emerge unhindered. The attachment is easy to dismantle and can be easily cleaned as required. At the same time the optics of the laser can be cleaned through the opening in the housing.

It is possible to filter the signals of the laser sensor such that cleaning of the attachment is possible manually in the attached state and during normal operation. It has been shown that cleaning at intervals of 3 weeks is sufficient.

BRIEF DESCRIPTION OF THE DRAWINGS

An embodiment of the invention is explained in more detail below by means of the drawings. It is shown in.

DETAILED DESCRIPTION OF A PREFERRED EMBODIMENT

Figure 1A:
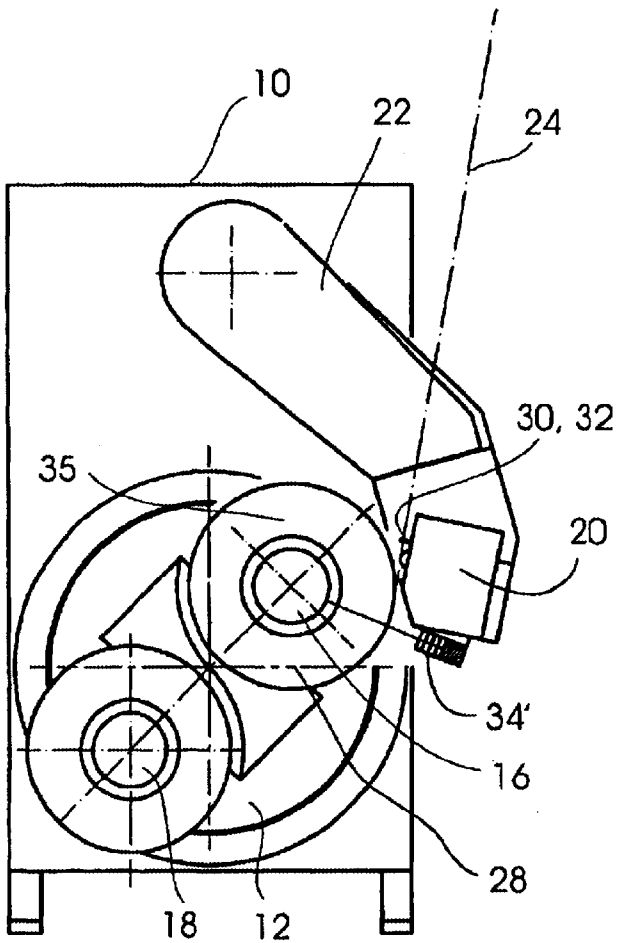
FIG. 1*a* the direct roving winder of an alternative embodiment in side view.
Figure 1:
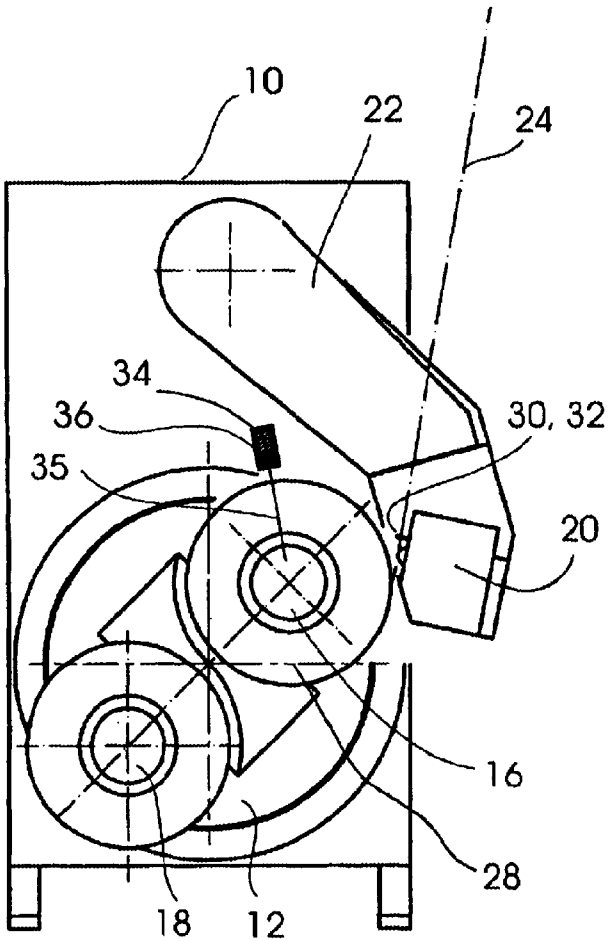
FIG. 1 the direct roving winder in side view.
Figure 2:
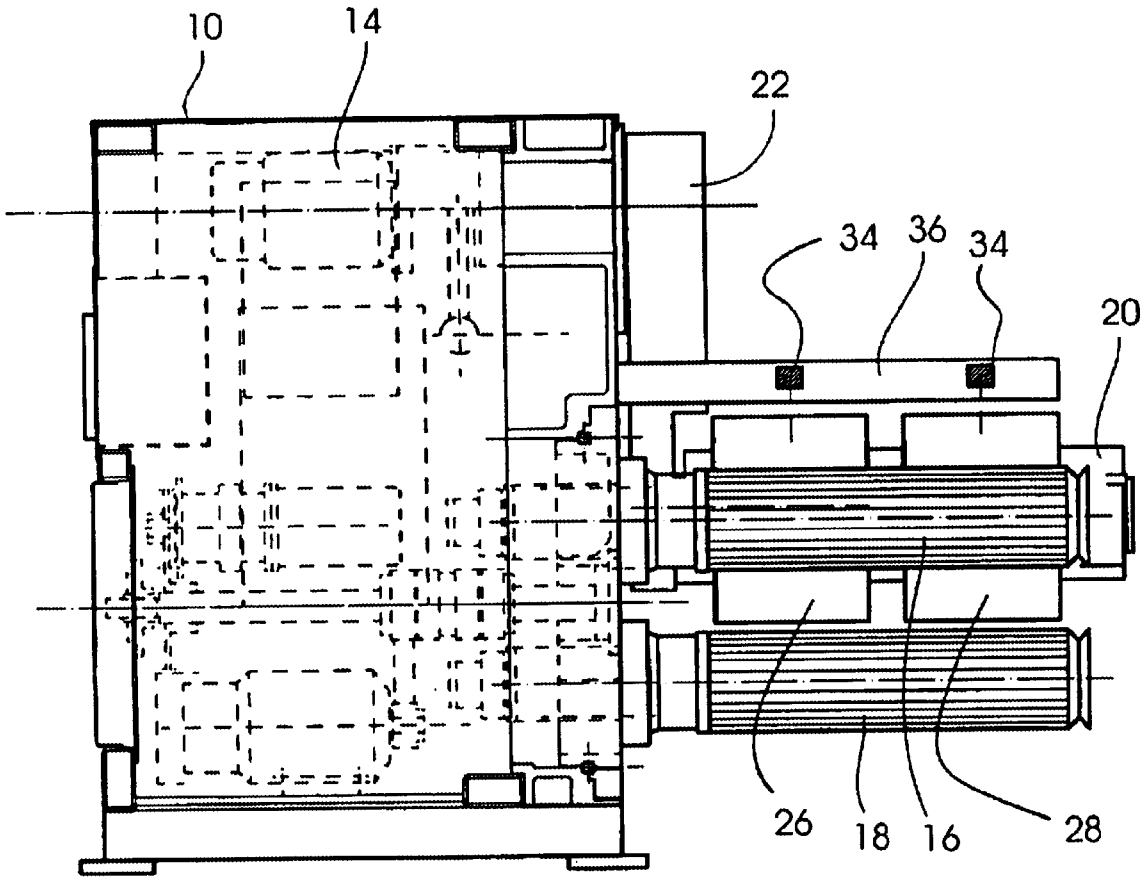
FIG. 2 the direct roving winder of FIG. 1 in front view.

The general construction of the roving winder, as it is shown in FIGS. 1 and 2, is of normal design. A spindle revolver 12 is rotatably housed in a machine frame 10. The spindle revolver 12 is driven by an electric motor 14 and two winding spindles 16, 18 are rotatably housed in it, offset at 180° to each other, projecting eccentrically. In the representation of FIGS. 1 and 2, the winding spindle 16 is located in the wind-on position, while the winding spindle 18 is in the waiting position. Above the spindle revolver 12, a cross-winding or traversing device 20 is connected to the machine frame 10 by means of a pivoting arm 22. The drive for pivoting the cross-winding device 20 and also the drive for the winding spindles 16, 18 is located inside the machine frame 10.

From two spinning positions arranged above the machine frame 10 and not shown in the drawing freshly spun rovings 24 are wound onto two packages 26, 28 which sit beside each other on the winding spindle 16. The cross-winding device 20 has two thread guides 30, 32 which guide the rovings back and forth within the traversing stroke in known manner, so that the rovings are deposited and wound onto the packages 26, 28 in a pre-set pattern.

For an accurate maintaining of the deposition pattern it is necessary for the thread guides 30, 32 to be located at the smallest possible constant distance from the surface of the package. The cross-winding device 20 is therefore pivoted away from the winding spindle 16 according to the growth of the package, with the distance to the package surface being controlled such that the rovings 24 are diverted by the traversing thread guides 30, 32 only in the direction of the axis of the winding spindles 16, 18 but not perpendicular to it, so that in the views in FIG. 1 the rovings 24 enter in a straight line.

For the accurate positioning of the cross-winding device 20 the growth of the packages 26, 28 is ascertained by means of sensors 34, with a sensor 34 of its own being provided for each package 26, 28. The sensors 34 are mounted on an arm 36 which projects from the machine frame 10 at a distance from the bearing of the spindle revolver 12 and parallel to the axis of the winding spindles 16, 18. The sensors 34 operate in known manner according to the echo principle. They contain a laser transmitter and a receiver for electromagnetic waves, e.g. laser impulses in the infrared region. The laser beams 35 are essentially directed perpendicular to the package surface. The distance between the sensor and the package surface is ascertained from the propagation time of the beam impulses 35 from the transmitter to the package surface and back to the receiver. By means of the constructional data of the roving winder, the momentary diameter of the packages 26, 28 can be ascertained from this, so that on reaching the envisaged package diameter a package change can be triggered, in which the spindle revolver 12 is rotated 180°, so that the spindle 18 is then brought into the wind-on position.

Laser distance sensors which operate on the triangulation principle are also suitable.

As shown in FIG. 1*a* the laser sensors 34' can also be mounted on the cross-winding device 20 so that they are pivoted with this. The momentary diameter of the packages 26, 28 is then ascertained from the position of the pivoting arm 22 and the distance to the package surface ascertained by the laser sensors 34'.

The package growth is obtained from the chronology of the package diameter. By means of the ascertained values of the package growth, the r.p.m. of the winding spindles 16, 18 and the movement of the cross-winding device 20, i.e. of the distance of the cross-winding device 20 from the package surface are controlled.

On the basis of the data of the package growth, the uniformity of the titre can also be monitored and titre variations can be countered in that the spinning nozzle temperature is slightly lowered at too high a titre and slightly raised at too low a titre.

Figure 3:
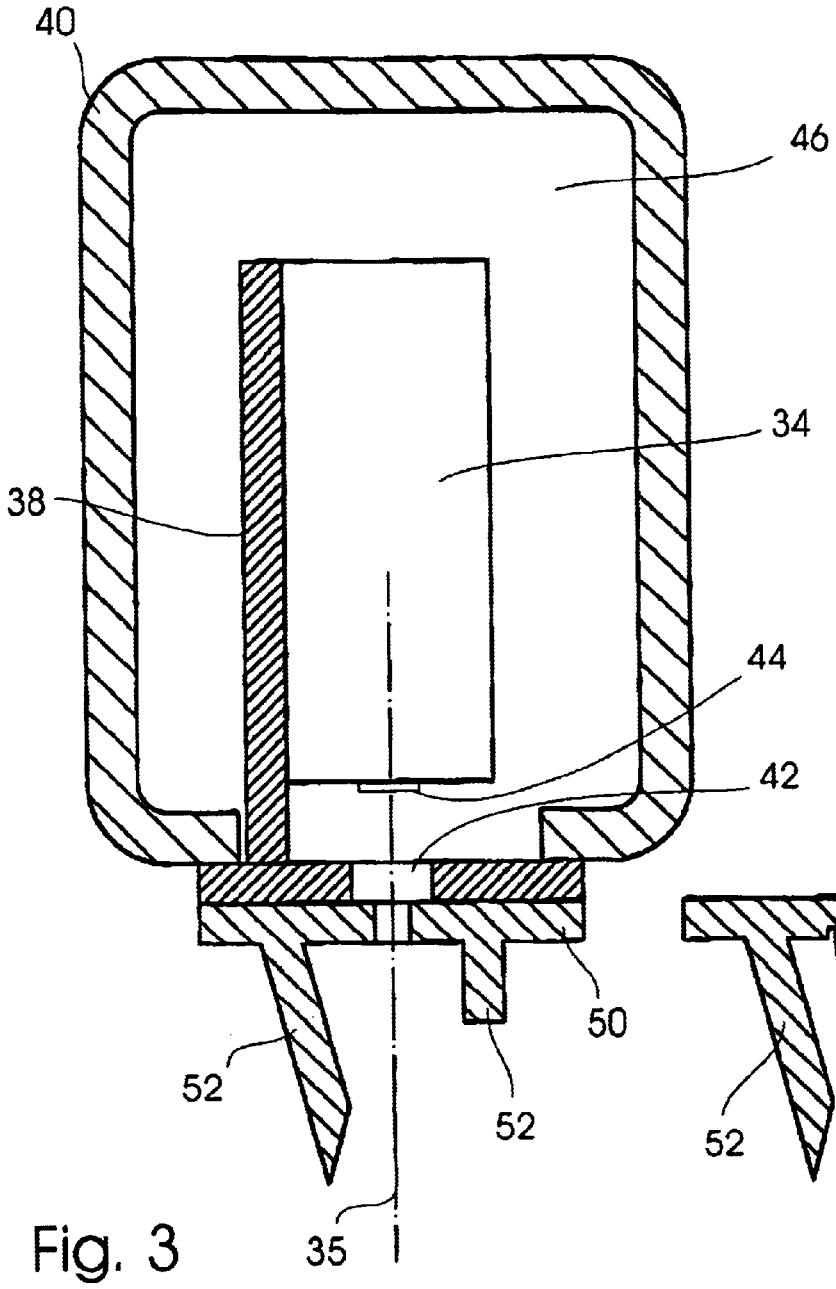
FIG. 3 the laser sensor in section.

In the operation of direct roving winders, a lot of dirt is produced by the water applied to the freshly spun rovings and the size, which represents a sticky substance, and also by glass fibre fly. These substances and glass fibres are whirled about by the packages 26, 28 rotating at high speed and distributed by the air vortex produced. In order to avoid malfunctions of the laser sensors 34, 34' occurring within a very short time, it is expedient to protect the laser sensors from this. According to FIG. 3, each laser sensor is arranged for this purpose in a housing 40 by means of an angle piece 38, an opening or slot 42 being present in the housing for the passage of the laser beam 35 and a free space 46 between the optics 44 of the laser sensor 34 and the opening 42. The free space 46 can extend around the whole laser sensor 34, so that there is a gap between the laser sensor 34 and the inside of the housing 40. In this free space, compressed gas, e.g. compressed air, is introduced via a compressed gas source which is not shown, which then exits from the opening 42 and thereby prevents the entry of dirt, i.e. water, size or glass fibre fly. With a width of the opening 42 of 3.5 mm, an excess pressure of 5 bar of the compressed gas is sufficient for this.

In addition, an attachment 50 is arranged in front of the opening 42, which surrounds the opening 42 and blocks off dirt. The attachment is a plate which has an opening aligned with the opening 42 for the laser beam and which on both sides of the opening has a deflecting screen or plate 52 projecting forwards. On the side on which particularly marked soiling is expected, the deflecting screen 52 can be lengthened. The front end of the deflecting screen 52 is pointed, so that adhering dirt can easily drop off. The attachment 50 is screwed fast to the front of the housing 40, so that it is easy to dismantle and can be cleaned as required. The optics 44 of the sensor 34 can be cleaned through the opening 42. The control device can be designed such that the signals of the laser sensor 34 are filtered such that cleaning of the attachment 50 is possible manually in the attached state and during normal operation without this being interpreted as an error signal.

Figure 4:
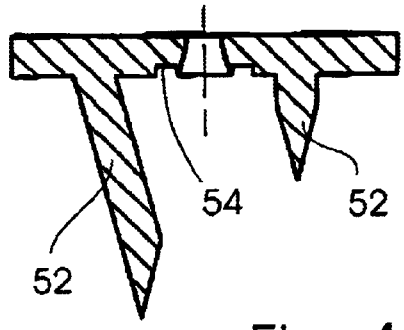
FIGS. 4 and 5 two further versions of the attachment for the laser sensor.
Figure 5:
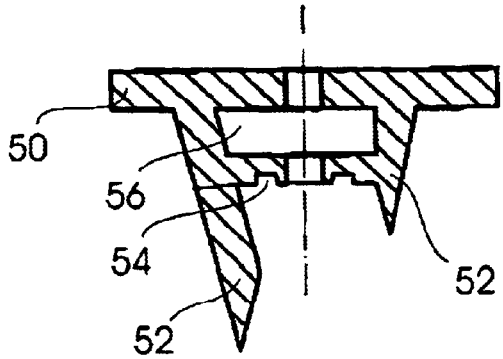

FIGS. 4 and 5 show further versions of the attachment 50, in FIG. 4 the opening in the attachment 50 widening towards the outside and having a sharp edge which is surrounded by an annular groove 54. In FIG. 5, the attachment 50 is provided with a hollow chamber 56 in which any penetrating dirt is caught. The edge of the opening in the front side of the hollow chamber 56 is pointed again and surrounded by an annular groove 54.

List of Reference Numbers

10 machine frame
12 spindle revolver
14 electric motor
16 winding spindle (wind-on position)
18 winding spindle (waiting position)
20 cross-winding or traversing device
22 pivoting arm
24 rovings
26, 28 packages
30, 32 thread guides
34 laser sensor
35 laser beam
36 arm
38 angle piece
40 housing
42 opening
44 optics
46 free space
50 attachment
52 deflecting screen
54 annular groove
56 hollow chamber

What is claimed is:

1. An apparatus on a direct roving winder for contactless detection of the actual diameter of a roving package, wherein the direct roving winder further includes a machine frame supporting at least one winding spindle for the production of one or more roving packages and a cross-winding device, the apparatus comprising:

a laser sensor including a transmitter and a receiver for laser radiation; and means for ascertaining the distance of the laser sensor from the package surface by means of the radiation from the transmitter to the package surface and back to the receiver;

wherein the laser sensor is arranged in a housing with an opening for the passage of the laser beam, a free space being provided between the laser sensor and the inside of the housing for the introduction of compressed gas which exits through the opening.

2. The apparatus according to claim 1, comprising an attachment with an opening which is aligned with the opening of the housing and with deflecting screens beside the opening.

3. A method for controlling a roving winder for the production of a package of rovings, comprising the following steps:

guiding rovings via a winding spindle rotating at a selected r.p.m. and a cross-winding device onto a package;

providing a laser sensor including a transmitter and a receiver for laser radiation;

ascertaining the distance of the laser sensor from the package surface by means of the radiation from the transmitter to the package surface and back to the receiver;

ascertaining the momentary diameter of the package from the ascertained distance of the laser sensor from the package surface;

controlling the distance of the cross-winding device from the package surface by means of the ascertained momentary diameter of the package; and controlling the r.p.m. of the winding spindle depending on a chronology of values of the actual diameter of the package.

4. A method for controlling a roving winder for the production of a package of rovings, comprising the following steps:

guiding rovings via a winding spindle rotating at a selected r.p.m. and a cross-winding device onto a package;

providing a laser sensor including a transmitter and a receiver for laser radiation;

ascertaining the distance of the laser sensor from the package surface by means of the radiation from the transmitter to the package surface and back to the receiver;

ascertaining the momentary diameter of the package from the ascertained distance of the laser sensor from the package surface;

controlling the distance of the cross-winding device from the package surface by means of the ascertained momentary diameter of the package;

determining the titre of the wound rovings from growth of the package diameter; and controlling the r.p.m. of the winding spindle depending on the determined titre, in order to avoid titre variations.

5. A method for controlling an apparatus for the spinning of rovings, in which glass filaments spun by a spinning position are wound to a package by means of a direct roving winder, comprising the following steps:

providing a laser sensor including a transmitter and a receiver for laser radiation;

ascertaining the distance of the laser sensor from the package surface by means of the radiation from the transmitter to the package surface and back to the receiver;

ascertaining the growth of the package diameter from the chronology of the distance of the laser sensor from the package surface; and controlling the temperature of the spinning position depending on the ascertained growth of the diameter of the package.

6. A method for controlling a roving winder, in which a plurality of roving packages is produced on at least one winding spindle, comprising the following steps:

providing a laser sensor including a transmitter and a receiver for laser radiation for each package;

ascertaining separately the distance of each of the laser sensor from the associated package surface by means of the radiation from the transmitter to the package surface and back to the receiver;

ascertaining the growth of the diameter of each of the packages from the chronology of the distance of the laser sensor from the package surface;

comparing the values of package growth ascertained for the individual packages; and producing a signal when the difference between the values of package growth ascertained for the individual packages exceeds a threshold value.

* * * * *